US005313727A

United States Patent [19]

Murray, Jr.

[11] Patent Number: 5,313,727

[45] Date of Patent: May 24, 1994

[54] DECORATIVE KINETIC DEVICE

[75] Inventor: Joseph E. Murray, Jr., Malden, Mass.

[73] Assignee: Merton Company, Ltd., Hong Kong, Hong Kong

[21] Appl. No.: 981,240

[22] Filed: Nov. 25, 1992

[51] Int. Cl.[5] ..... G09F 19/00; G09F 19/08

[52] U.S. Cl. ..... 40/410; 40/411; 40/414; 40/429; 40/430; 40/470; 446/267; 446/236; 446/178; 428/11

[58] Field of Search ..... 40/410, 409, 411, 414, 40/429, 470, 430; 446/298, 267, 236, 178, 179, 156, 159; 472/65; 428/7, 11, 13

[56] References Cited

U.S. PATENT DOCUMENTS

| | | | |
|---|---|---|---|
| 4,641,445 | 2/1987 | Rossi | 40/410 |
| 4,923,429 | 5/1990 | Lewis | 446/267 |
| 5,090,144 | 2/1992 | Liu | 40/410 |
| 5,098,084 | 3/1992 | Culver | 40/410 |
| 5,110,636 | 5/1992 | Hou | 40/410 |
| 5,200,239 | 4/1993 | Chen | 40/410 |
| 5,261,848 | 11/1993 | Kaplan et al. | 446/267 |

*Primary Examiner*—Clifford D. Crowder
*Assistant Examiner*—Gloria Hale
*Attorney, Agent, or Firm*—Ostrolenk, Faber, Gerb & Soffen

[57] ABSTRACT

A decorative kinetic device which includes a transparent hollow dome containing a fluid and a plurality of small particles. The dome is open on its bottom and is mounted on a base having a pumping chamber formed therein. The top of the pumping chamber, which serves as the bottom of the dome, includes an intake hole and an outlet hole to provide flow paths between the dome and the pumping chamber. A pump impeller is positioned within the pumping chamber to circulate the fluid and the particles, the impeller being rotated by a motor positioned in the base below the pumping chamber. An extension member is attached to and extends vertically upward from the pump impeller into the dome and is adapted to receive a decorative object. A transport tube having an intake port and an outlet port is positioned in the dome such that the intake port is connected to the outlet hole of the pumping chamber and the outlet port of the transporting tube is positioned near the top of the dome. Rotation of the impeller causes the fluid and the particles to be drawn through and out of the pumping chamber into and through the transport tube, out of the transport tube near the top of the dome and down through the dome to the pumping chamber again. Simultaneously, the rotating extension member is caused to rotate.

19 Claims, 7 Drawing Sheets

FIG. 8a
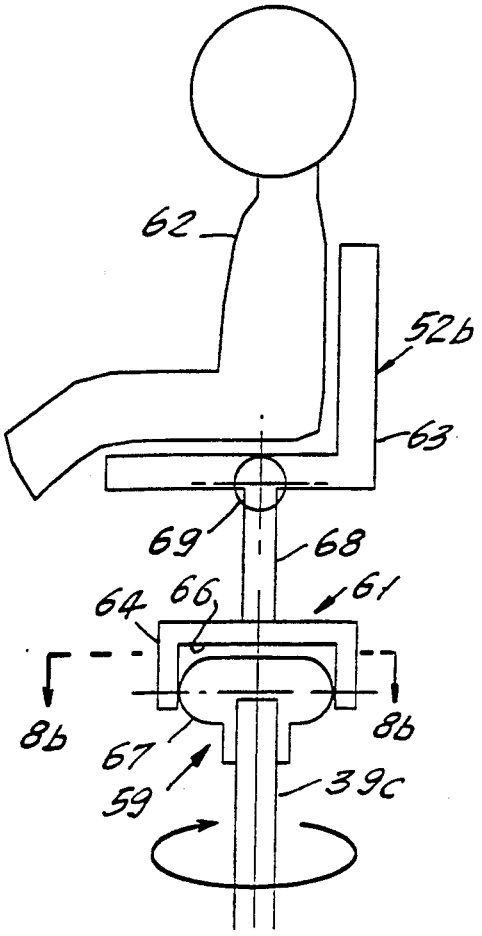
FIG. 9a
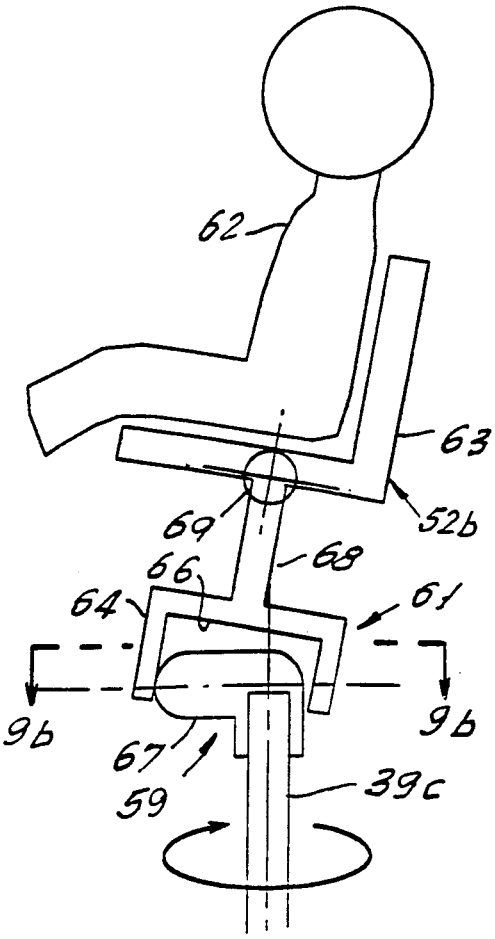
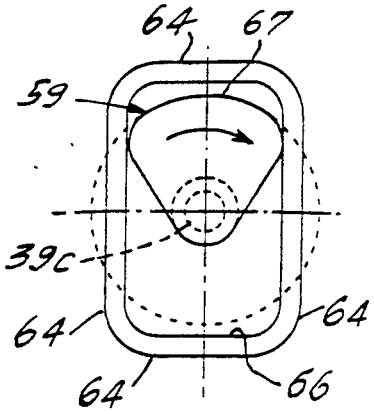
FIG. 8b
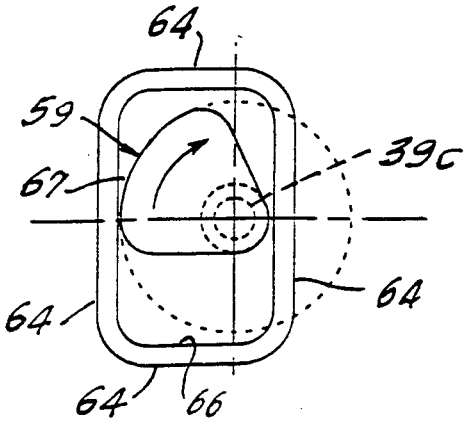
FIG. 9b

DECORATIVE KINETIC DEVICE

BACKGROUND OF THE INVENTION

The present invention relates to decorative devices such as decorative balls commonly known as snowglobes or snowmovers and, more particularly, to such devices which are kinetic.

Decorative devices such as decorative balls are well known. Conventionally, they include a transparent ball having a decorative object or scene therein. The ball is filled with a transparent fluid and tiny particles simulating snow.

The devices are generally static, that is, they contain no moving parts. In order to achieve the effect of a snowfall, the balls are manually shaken to agitate the fluid and particles contained within the ball; an artificial or simulated snowfall is obtained as the particles settle to the bottom. This effect, however, is short lived and in order to again achieve a snowfall the ball must again be shaken.

In order to overcome the short lived nature of the snowfall, some decorative devices include a means, such as a motor and blade, to circulate the fluid continuously within the ball. While this provides a dynamic or kinetic effect to the device, the fluid is not circulated such that the particles flow in a realistic manner from top to bottom as would occur in an actual snowfall. Instead, the particle flows are multidirectional, thereby giving a less pleasing and attractive effect to the snowfall.

Additionally, those decorative devices which include a continuous snowfall are not fully dynamic since the decorative object within the ball is stationary.

SUMMARY OF THE INVENTION

Accordingly, it is an object of the present invention to provide a decorative kinetic device which provides a more realistic simulation of snowfall, while at the same time providing a kinetic action to a decorative object contained within the device, so that the overall effect is more pleasing, attractive and aesthetic.

It is a further object of the invention to provide such a kinetic device which not only provides a very aesthetic effect, but also is efficient, reliable, compact and simple to manufacture.

The foregoing and other objects are achieved in accordance with the present invention by a decorative kinetic device which includes a transparent hollow dome containing fluid and a plurality of small particles. The dome is mounted on a base having an internal pumping chamber disposed below the top surface of the base, the top surface of the base also serving as the bottom of the dome. An impeller is mounted in the chamber for circulating fluid and particles which are drawn into the chamber from the dome through an intake hole formed in the top surface of the base, the fluid being pumped out of the chamber through an outlet hole also formed in the top surface.

An extension member upon which a decorative object may be mounted is mounted for rotation with the impeller, and the impeller and the extension member are rotated by suitable means, such as a motor, mounted within the base.

Preferably, the fluid and particles exiting the chamber are directed to an intake port of a vertical transport tube mounted in the dome, the fluid and particles exiting the vertical transport tube through an outlet port located near the top of the dome. Accordingly, the particles exit the outlet port near the top of the dome and slowly descend down toward the intake hole of the top surface for recirculation to thereby achieve a continuous, simulated, realistic snowfall.

Preferably, the transport tube is opaque so that the upward moving particles are not visible. Additionally, the outlet port of the transport tube preferably has a reduced cross-section to impart an increased velocity to the particles as they exit the exit port so that they are not clearly visible. The entire effect, therefore, is of particles traveling downwardly and becoming visible as their velocity decreases, thereby providing a very close simulation to an actual snowfall and, consequently, a very pleasing and attractive effect. Simultaneous motion within the dome of the decorative object adds considerably to the overall aesthetics of the present invention.

Other features and advantages of the present invention will be more fully understood when considered in conjunction with the accompanying drawings.

Figure 6:
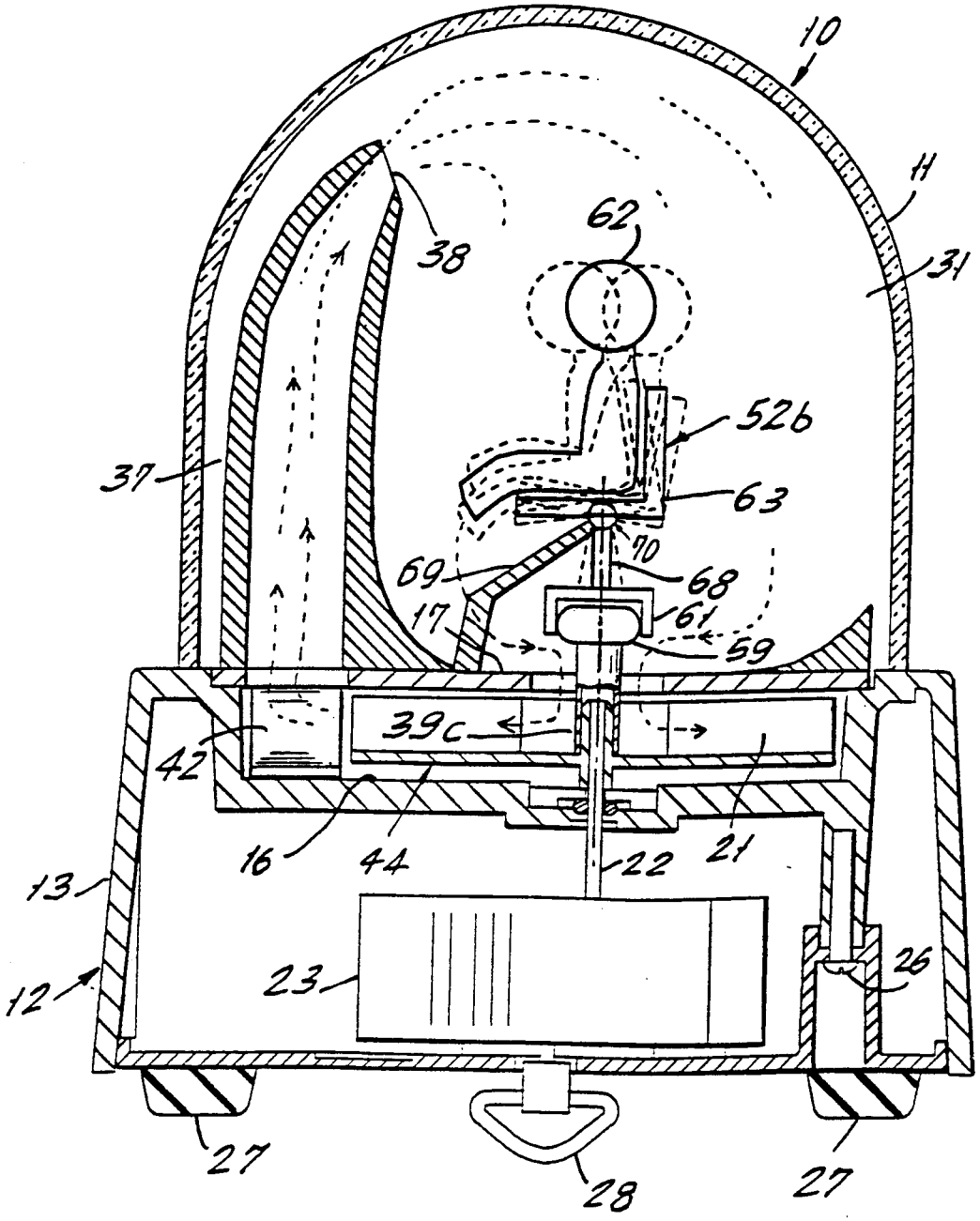
FIG. 6 is a vertical sectional view of the device of FIG. 1 showing another alternative embodiment for mounting a decorative object.
Figure 7A:
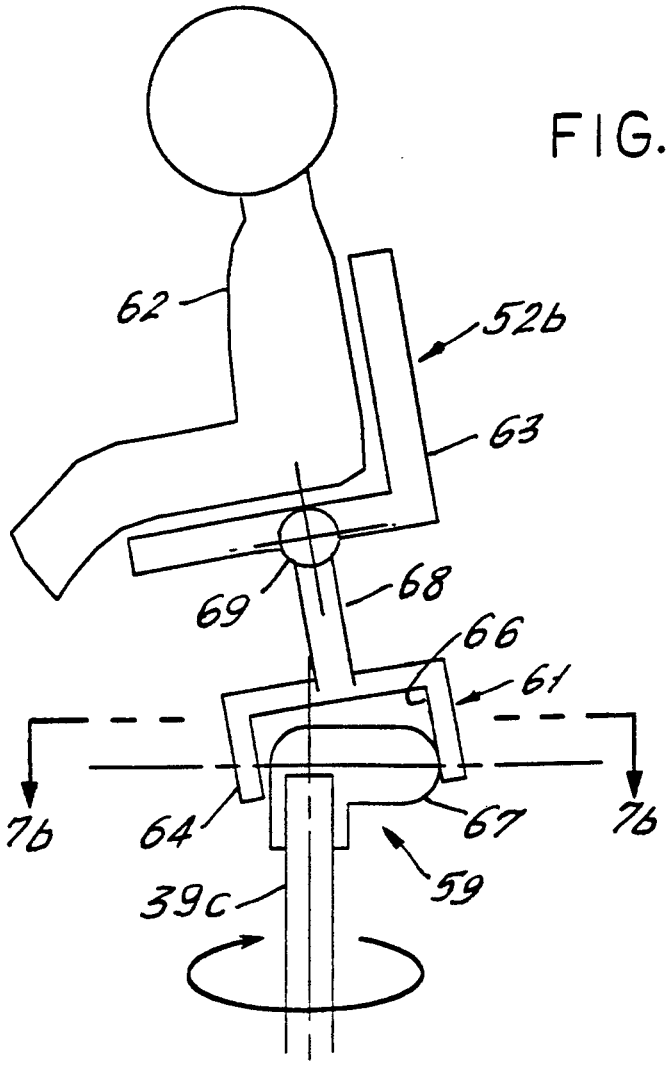
Figure 7B:
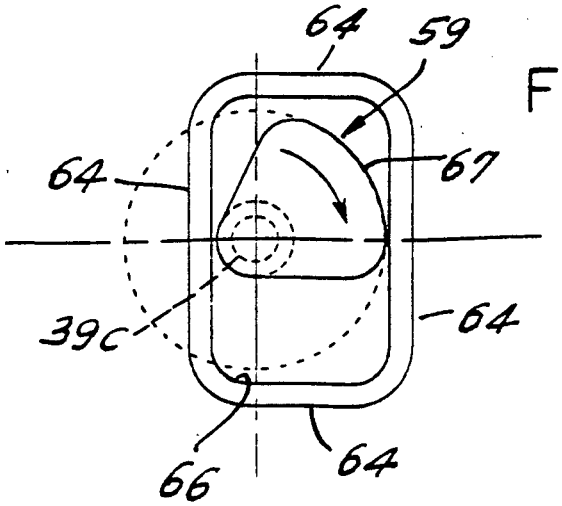

FIGS. *7a*, *8a* and *9a* are vertical views illustrating different positions of the decorative object of FIG. 6 during operation thereof; and FIGS. *7b*, *8b* and *9b* are horizontal views taken along the lines *7b—7b*, *8b—8b* and *9b—9b* of FIGS. *7a*, *8a* and *9a*, respectively.

DETAILED DESCRIPTION OF THE INVENTION

Figure 1:
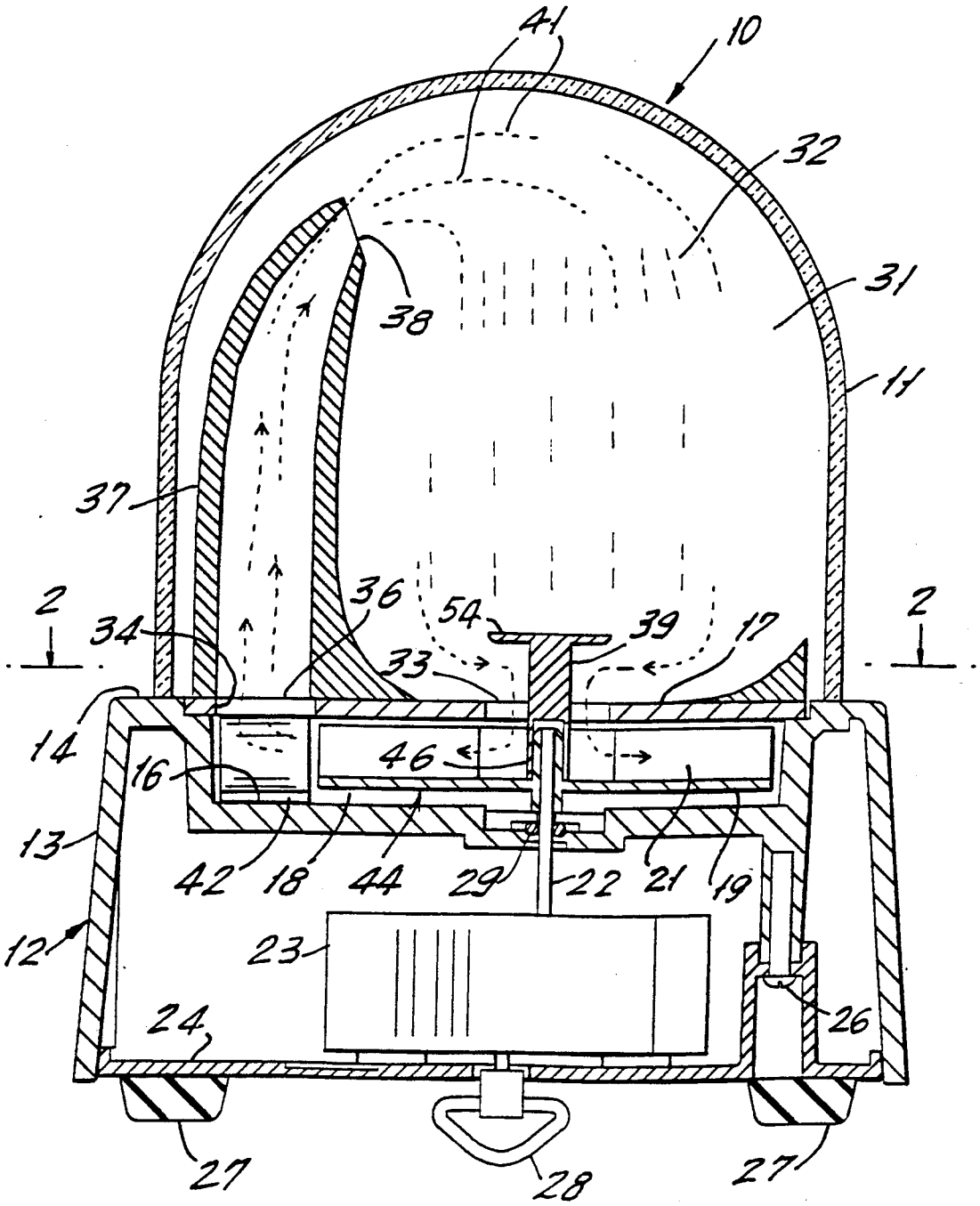
FIG. 1 is a vertical sectional view of a decorative kinetic device illustrating certain principals of the present invention.

Referring now to the drawings and, more particularly, to FIG. 1, there is shown a decorative kinetic device 10 in accordance with the present invention. The device 10 includes a transparent dome 11 made of glass or plastic mounted on a base 12. The base 12 includes an annular skirt 13 having a horizontal annular first top surface 14 which extends inwardly to a recessed second surface 16. The base 12 also includes a plate 17 spaced above the recessed surface 16 and extending to the annular first surface 14 at the same height thereof.

The plate 17 and the recessed second surface 16 together form an internal pumping chamber 18. An impeller 19 having a plurality of blades 21 (FIG. 2), is supported within the chamber 18 for rotation. The impeller 19 is supported on the shaft 22 of a motor 23 which, in turn, is supported on a bottom plate 24 of the base 12. The bottom plate 24 of the base is connected to the skirt 13 by suitable means, such as a screw 26. Advantageously, the bottom plate 24 also includes feet 27 for supporting the device 10 upon a flat surface, such as a table.

The motor 23 is of the type commonly used in music boxes, such as an 18 Note Music Unit/Motor from Sankyo Mfg. Co. Ltd. Typically, such motors 23 are activated by a windup key 28 coiling a spring (not shown). The motor shaft 22 is journaled in the second surface by means of O-rings 29 which also provide a seal between the pumping chamber 18 and the rest of the base.

The dome 11 is filled with a clear fluid 31, such as a mixture of 60% water and 40% propylene glycol, which contains small particles 32 of a material such as polystyrene or acrylic plastic.

The plate 17 includes an approximately centrally located intake hole 33 through which the fluid 31 and particles 32 in the dome may be drawn into the pumping chamber 18, and an outlet hole 34 spaced near the periphery of the plate 17. The outlet hole 34 communicates with an intake port 36 of a vertical transport tube 37 mounted within the dome 11. The transport tube 37 preferably is opaque so that particles 32 that are flowing vertically upward in the tube are not visible. The circulation paths of the fluid 31 and the particles 32 are representationally depicted by the dashed lines 41. The transport tube 37 extends to a point adjacent the top of the dome 11 and includes an outlet port 38. Preferably, the outlet port 38 has a reduced cross-section compared to the cross-section of the internal body of the tube 37 which, together with the flow rate of the circulating fluid, cause the particles exiting the outlet port 38 to have an increased velocity. Such an increased velocity combined with the small size of the particles 32 essentially cause the particles not to be readily visible to an observer. As the particles 32 travel away from the outlet port 38 and into the larger volume area of the dome 11 they slow down and become visible. The entire effect, therefore, is very close to that which one would observe in an actual snowfall.

An extension member 39 is suitably mounted to the impeller 19 for rotation therewith. A suitable decorative object (not shown) may be mounted on the rotatable extension member 39.

Figure 3:
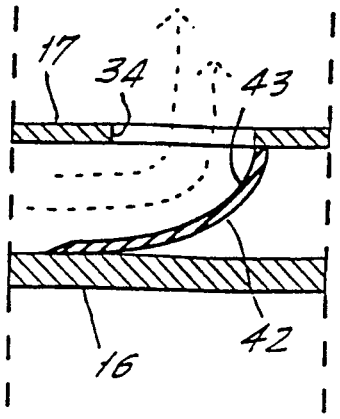
FIG. 3 is a horizontal sectional view taken along the lines of 3—3 of FIG. 2.

Preferably, as best seen in FIG. 3, the chamber 18 includes a flow director 42 located below the outlet hole 34. The flow director 42 has a flow directing surface 43 which extends from the back of the outlet hole 34 in a curved path which inclines downwards towards incoming fluid 31 and particles 32 which are directed to the outlet hole 34 by the impeller 19. The fluid 31 and particles 32 are, therefore, caused to change direction upwardly out of the outlet hole 34 and into the intake port 36 of the vertical transport tube 37.

Referring back to FIGS. 1 and 2, the impeller 19 includes a disk member 44 having a central hub 46 which is sized to fit over the motor drive shaft 22 and which may be firmly attached thereto by suitable means such as a set screw (not shown). Mounted on the disc member 44 are the blades 21. The spacing between the disc member 44 and the bottom of the pumping chamber 18, that is, the second surface 16, is selected such as to be larger than the size of the particles 32. Additionally, the diameter of the disc member 44 is at least equal to the area swept by the blades 21. This configuration of the impeller 19 reduces boundary layer drag on particles 32 at the bottom of the pump chamber 18, that is, the disc member 44 catches particles 32 and prevents contact of the particles 32 with the second surface 16. Additionally, there is no relative motion between the blades 21 and the second surface 16 since the blades are separated from the second surface by the disc member 44. The spacing between the disc member 44 and the second surface 16 is larger than the sizes of the particles 32 to thereby prevent jamming of particles 32 in the space between the disc member 44 and the second surface 16.

Figure 2:
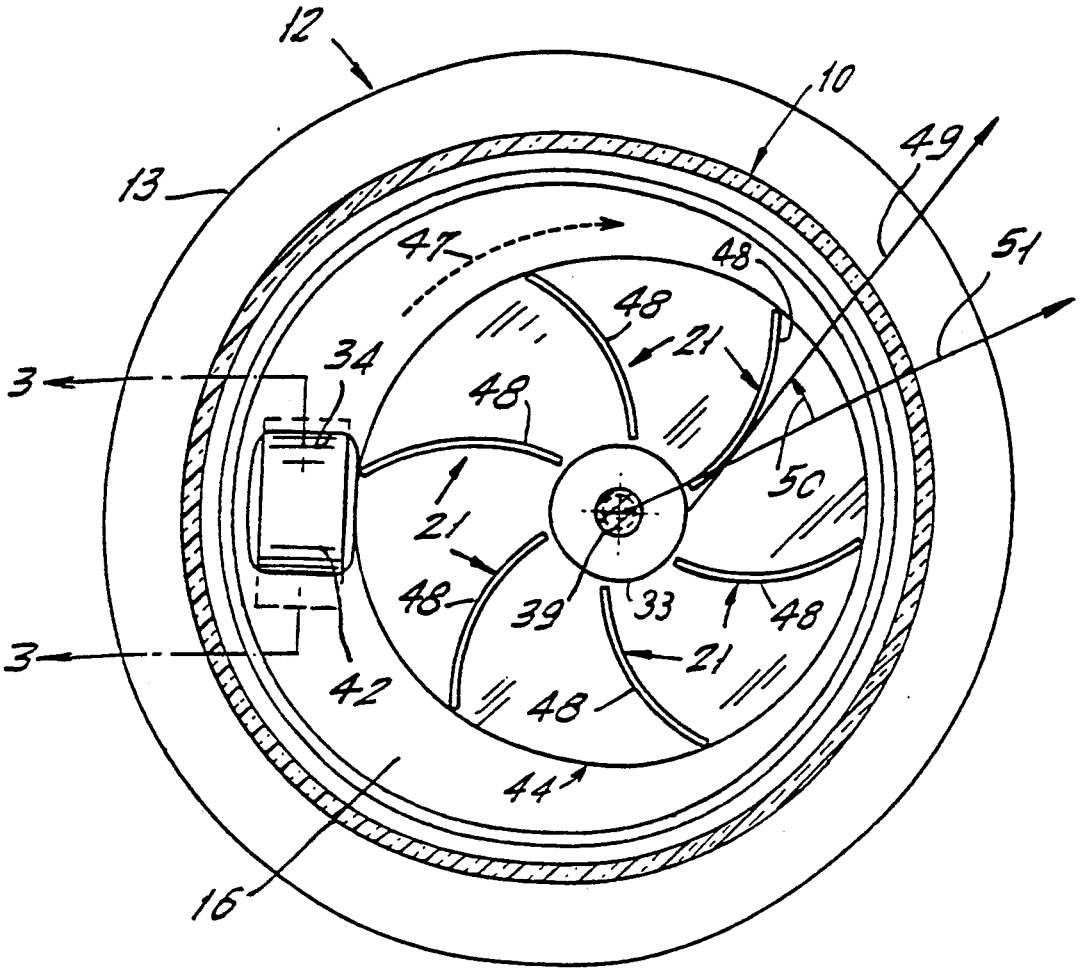
FIG. 2 is a horizontal sectional view taken along the lines 2—2 with portions removed for the sake of clarity.

Referring to FIG. 2, each of the impeller blades 21 has a substantially convex pushing surface 48 so that the blades bulge outward in the direction of rotation shown by the arrow 47. More specifically, the curve of the blades 21 is such that a tangent line, such as the line 49, through any point on the blade is oriented at an angle, such as the angle 50, which is rotated in a direction opposite the direction of rotation 47 from a radial line, such as the radial line 51, through the same point by an amount greater than 0° and less than 90°. This configuration of the blades 21 reduces frictional drag against the particles 32. More specifically, such curving and angling of the pushing surfaces 48, cause each of the blades 21 to exert an outward camming force against the particles 32 which adds to the centrifugal force of rotation. The angle of curvature of each of the blades 21 is such as to reduce the frictional forces of the particles 32 against the blades as compared to other blades, such as radial blades, and also reduces rotational velocity which may be imparted to the particles 32 by radial blades.

In operation, the device 10 is actuated by winding the motor 23 with the wind-up key 28. Upon actuation of the motor 23, the motor rotates the impeller 19, causing fluid 31 and particles 32 to be drawn into the pumping chamber and directed by the impeller 19 toward the flow director 42 which imparts an upward movement to the fluid and particles causing them to enter the transport tube 37. The fluid 31 and the particles 32 are then conveyed upwardly through the transport tube 37 and exit from the outlet port 38, which, as noted, because of its reduced size causes virtual invisibility of the particles as they exit the outlet port, the particles becoming visible as they approach the middle of the top half of the dome so that the particles descend in a manner very closely approximating an actual snowfall. Simultaneously, the motor shaft 22 drives the extension member 39.

Figure 4:
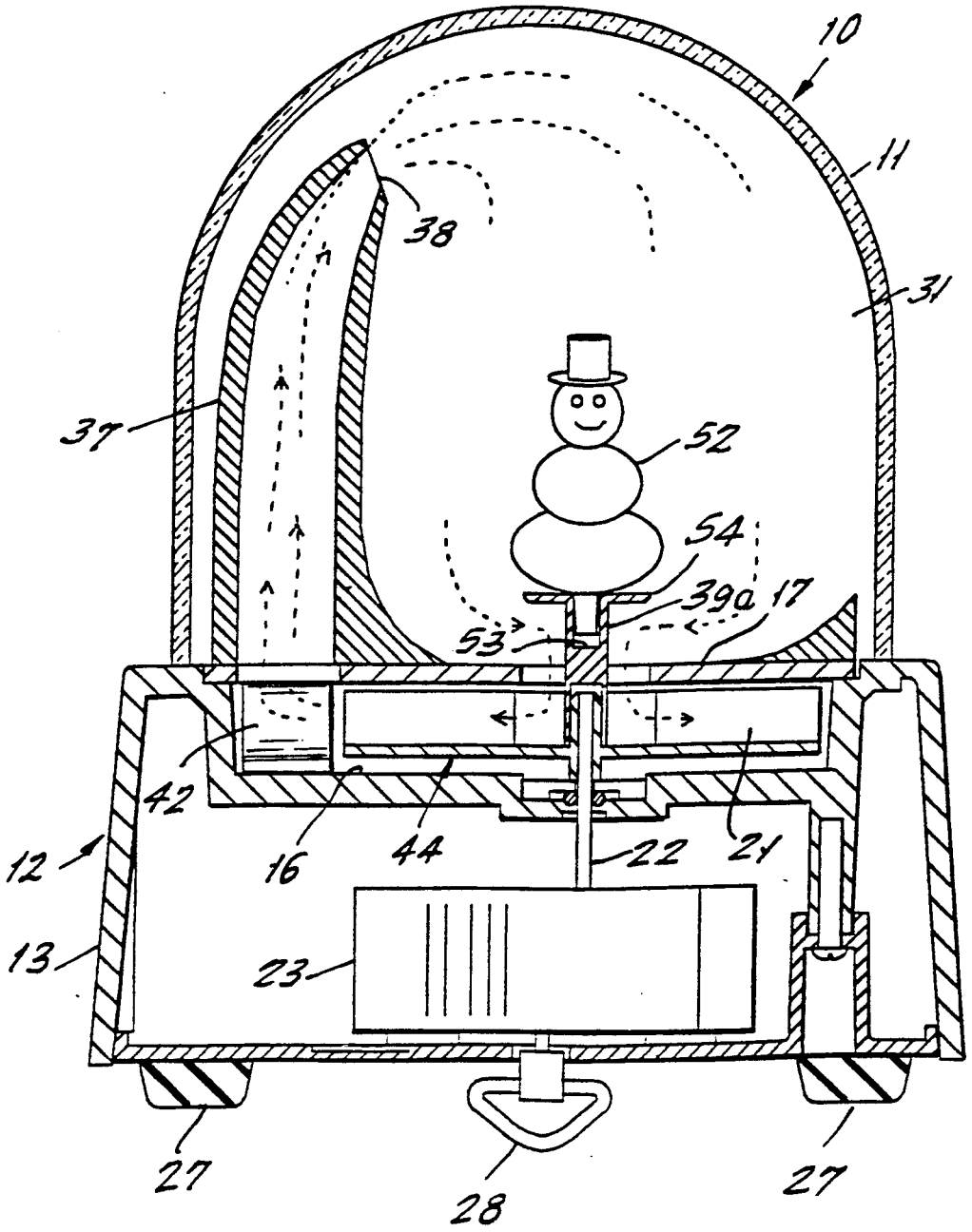
FIG. 4 is a vertical sectional view of the embodiment of FIG. 1 showing a decorative object mounted for rotation within the device.

Referring now to FIG. 4, there is shown a decorative object 52 which is attached to an extension member **39*a* similar to the extension member 39. Extension member 39*a* includes a central recess 53 and the decorative object 52 includes a dependent projection 54 which is inserted into the recess 53 to mount the decorative object 52 for rotation with the extension member 39*a***.

Decorative objects may be directly attached to the extension member 39 or **39*a*, as in FIG. 4**, or may be coupled thereto by suitable mechanical motion transfer means, such as a cam, pulley, gear, friction wheel, etc.

Figure 5:
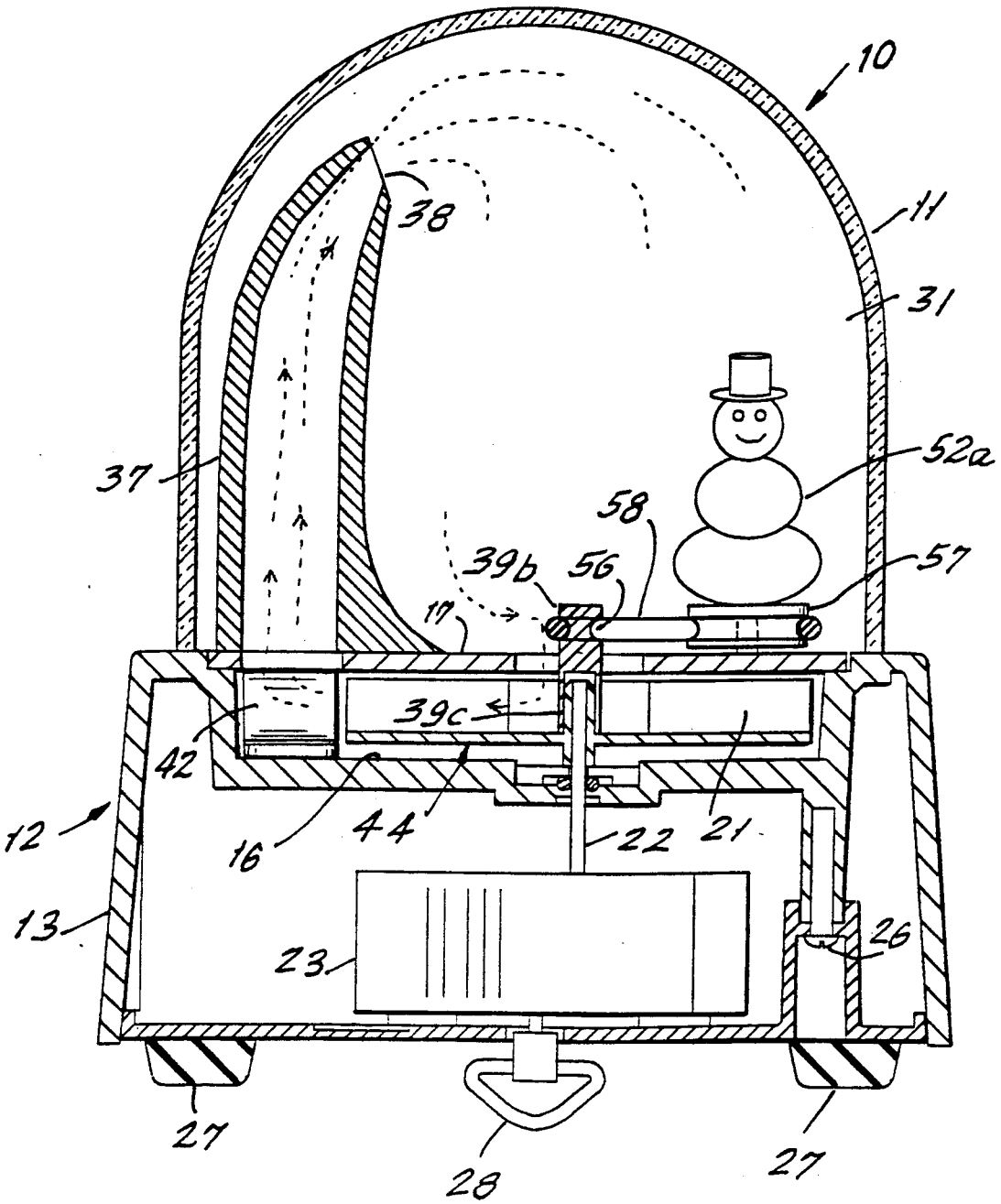
FIG. 5 is a vertical sectional view of the device of FIG. 1 showing an alternative embodiment for mounting a decorative object.

Turning now to FIG. 5, there is shown an alternative embodiment for mounting a decorative object **52*a*. In this embodiment, the decorative object 52*a* is attached to an extension member 39*b* by means of a pulley 56 formed in the extension member and a pulley 57 mounted to the decorative object. An O-ring 58 or other suitable coupling member is used to transmit motion from the pulley 56 to the pulley 57 attached to the decorative object 52*a***.

Turning now to FIG. 6, there is shown another embodiment in which a decorative object **52*b* is caused to move by means of a cam 59 and a cam follower 61. More specifically, the decorative object 52*b* in this case is a model 62 of person sitting in a chair 63. The chair 63 is mounted on the cam follower 61 which includes four depending sides 64** (see, for example, FIG. *7b*) which together define a rectangular opening 66. The cam 59 is in the form of an eccentric 67 mounted to an extension member 39*c*. The cam follower 61 is mounted to the chair 63 by means of an arm 68, the connection between the arm 68 and the chair 63 forming a pivot point 70 for the chair. Suitable means, such as support members 69 (only one of which is shown) attached to and extending up from plate 17 to pivot point 70 are provided for supporting the chair 63 at the pivot point 70.

As seen in FIGS. *7a, 7b, 8a, 8b* and *9a, 9b*, as the cam 59 rotates, the chair 63 pivots from the position shown in FIG. *7a* in which the chair 63 is pivoted forwardly to the position shown in *8a* in which the chair 63 is level and then to the position shown in FIG. *9a* in which the chair 62 inclines backwardly. The overall effect, as will be appreciated, is of a person rocking in a rocking chair. The shape of the cam 59 and the cam follower 61 can be varied to obtain other types of motion. Thus, in order to obtain harmonic motion of the chair 63, the cam 59 could be in the form of an eccentrically mounted pin, and the cam follower 61 could be in the form of a slot formed in the underside of the chair 63 or member supporting the chair 63.

Other coupling arrangements may also be used advantageously. Thus, as noted above, the decorative object may be coupled for movement by means of friction wheels, gears or other suitable mechanical motion transfer means, not shown.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

WHAT IS CLAIMED IS:

1. A decorative kinetic device, comprising:

a base having an internal pumping chamber;

a transparent dome mounted on the base above the pumping chamber, the dome containing a fluid and a plurality of small particles;

the pumping chamber having spaced inlet and outlet holes communicating with the dome;

an impeller mounted in the pumping chamber to circulate the fluid and the particles from the dome through the inlet hole through the pumping chamber and back to the dome through the outlet opening;

means for supporting a decorative object mounted for rotation in the dome; and means for simultaneously rotating the impeller and the supporting means.

2. The device of claim 1, further including a transport tube having an intake port and an outlet port, the transport tube being positioned in the dome such that the intake port communicates with the outlet hole of the chamber and the outlet port is positioned near the top of the dome.

3. The device of claim 2, wherein the impeller circulates the fluid and the particles at a predetermined flow rate and the cross-sectional area of the outlet port of the transporting tube is chosen, in conjunction with the predetermined flow rate, to be sufficiently small such that the particles exit the outlet port with a velocity high enough to cause diminished visibility of the particles in the top region of the dome near the outlet port, the predetermined flow rate being chosen such that the particles move downward past the top region of the dome with a velocity low enough to cause easy visibility of the particles.

4. The device of claim 2, wherein the supporting means includes an extension member connected to the impeller for rotation therewith, mechanical motion transferring means connected to the extension member and means for connecting a decorative object to the mechanical motion transferring means such that rotation of the extension member causes the decorative object to move.

5. The device of claim 4, wherein the motion transferring means includes a cam connected to the extension member and a cam follower connected to the decorative object.

6. The device of claim 4, wherein the motion transferring means includes a first pulley mounted for rotation with the extension member, a second pulley mounted for rotation with the decorative object and means coupling rotation of the first pulley to the second pulley.

7. The device of claim 1, wherein the impeller directs the fluid and particles toward the outlet opening, and wherein the pumping chamber has an upward flow-directing ramp located below the outlet opening, the ramp having a flow-directing surface extending downward from the outlet opening in an inclined path toward the fluid and particles being directed thereto by the impeller.

8. The device of claim 1, wherein the impeller rotates in a predetermined rotational direction, and the impeller includes a plurality of blades each having a curved pushing surface, each pushing surface having a substantially convex shape which curves outward toward the predetermined rotational direction such that a tangent line through each point on the curved pushing surface is oriented at an angle which is rotated, in a direction opposite the predetermined rotational direction, from a radial line through the same point, by an amount greater than 0° and less than 90°.

9. A decorative kinetic device, comprising:

a transparent hollow dome containing a fluid and a plurality of small particles, the dome being open at the bottom and having an annular bottom edge;

a base positioned below the dome, the base having a horizontal annular first surface to which the annular bottom edge of the dome is sealingly joined, a substantially horizontal disk-shaped second surface extending inward from and joined to the first surface, and a plate having a substantially horizontal disk-like shape and positioned parallel to and above the second surface such that the bottom surface of the plate forms the top of a horizontal pumping chamber, and the top surface of the plate forms a bottom closure for the dome thereby forming a dome chamber, the plate further containing an intake hole near its center and an outlet hole near its edge, the intake and outlet holes providing flow paths between the dome chamber and the pumping chamber;

a pump impeller positioned within the pumping chamber to rotate in a horizontal plane about a vertical axis;

a transporting tube having an intake port and an outlet port and positioned such that the intake port is joined to the outlet hole of the plate, and the outlet port is positioned near the top of the dome chamber; and a motor positioned below the second surface of the base, the plate having a motor shaft hole and the motor being positioned such that the shaft of the motor extends through the motor shaft hole and engages the pump impeller to rotate the impeller upon rotation of the motor, rotation of the impeller causing the fluid to circulate around a fluid circulation path wherein the fluid is drawn into the intake hole, out the outlet hole, into the intake port, upward inside the transport tube, out the outlet port and down through the dome chamber to the intake hole again.

10. The device of claim 9, wherein the pump impeller has a disk member centered on the vertical axis and positioned parallel to and spaced above the second surface of the base by a distance larger than the size of the particles, the disk member having blades extending upward from the top surface of the disk member to a plane spaced below the bottom surface of the plate by a distance larger than the size of the particles, the disk member having a diameter large enough to cover the area swept over by the blades.

11. The device of claim 10, wherein the disk member rotates in a predetermined rotational direction, and the blades each have a curved pushing surface, the pushing surface having a substantially convex shape which curves outward toward the predetermined rotational direction such that a tangent line through each point on the pushing surface is oriented at an angle which is rotated, in a direction opposite the predetermined rotational direction, from a radial line through the same point, by an amount greater than 0° and less than 90°.

12. The device of claim 9, wherein the impeller directs the fluid and particles toward the outlet opening, and wherein the pumping chamber has an upward flow-directing ramp located below the outlet opening, the ramp having a flow-directing surface extending downward from the outlet opening in an inclined path toward the fluid and particles being directed thereto by the impeller.

13. The device of claim 9, further including an extension member connected to the impeller and positioned to extend vertically upward from the pumping chamber through the intake hole and into the dome chamber such that when the impeller rotates within the pumping chamber the upper portion of the extension member rotates within the dome chamber.

14. The device of claim 13, further including mechanical motion transferring means connected to the extension member and means for connecting a decorative object to the mechanical motion transferring means such that rotation of the extension member causes the decorative object to move.

15. The device of claim 14, wherein the motion transferring means includes a cam connected to the extension member and a cam follower connected to the decorative object.

16. The device of claim 14, wherein the motion transferring means includes a first pulley mounted for rotation with the extension member, a second pulley mounted for rotation with the decorative object and means coupling rotation of the first pulley to the second pulley.

17. The device of claim 14, wherein the pump impeller has a disk member centered on the vertical axis and positioned parallel to and spaced above the second surface of the base by a distance larger than the size of the particles, the disk member having blades extending upward from the top surface of the disk member to a plane spaced below the oottom surface of the plate by a distance larger than the size of the particles, the disk member having a diameter large enough to cover the area swept over by the blades.

18. The device of claim 17, wherein the disk member rotates in a predetermined rotational direction and the blades each have a curved pushing surface, the pushing surface having a substantially convex shape which curves outward toward the predetermined rotational direction, such that a tangent line through each point on the pushing surface is oriented at an angle which is rotated, in a direction opposite the predetermined rotational direction, from a radial line through the same point, by an amount greater than 0° and less than 90°.

19. The device of claim 18, wherein the impeller directs the fluid and particles toward the outlet opening, and wherein the pumping chamber has an upward flow-directing ramp located below the outlet opening, the ramp having a flow-directing surface extending downward from the outlet opening in an inclined path toward the fluid and particles being directed thereto by the impeller.

* * * * *